US010923826B2

(12) United States Patent
Murphy

(10) Patent No.: US 10,923,826 B2
(45) Date of Patent: Feb. 16, 2021

(54) DOUBLE HELICAL ANTENNA

(71) Applicant: Wade Antenna Inc., Brantford (CA)

(72) Inventor: Ryan Murphy, Brantford (CA)

(73) Assignee: Wade Antenna Inc., Brantford (CA)

( * ) Notice: Subject to any disclaimer, the term of this patent is extended or adjusted under 35 U.S.C. 154(b) by 0 days.

(21) Appl. No.: 16/629,505

(22) PCT Filed: Jul. 11, 2018

(86) PCT No.: PCT/CA2018/050847
§ 371 (c)(1),
(2) Date: Jan. 8, 2020

(87) PCT Pub. No.: WO2019/010577
PCT Pub. Date: Jan. 17, 2019

(65) Prior Publication Data

US 2020/0381836 A1 Dec. 3, 2020

Related U.S. Application Data

(60) Provisional application No. 62/531,392, filed on Jul. 12, 2017.

(51) Int. Cl.

| | |
|---|---|
| ***H01Q 1/28*** | (2006.01) |
| ***H01Q 11/08*** | (2006.01) |
| ***H01Q 21/24*** | (2006.01) |
| ***H01Q 5/40*** | (2015.01) |

(52) U.S. Cl.
CPC ..... *H01Q 11/08* (2013.01); *H01Q 5/40* (2015.01); *H01Q 21/24* (2013.01); *H01Q 1/28* (2013.01)

(58) Field of Classification Search
CPC ..... H01G 11/08; H01G 5/40; H01G 21/24; H01G 1/28
See application file for complete search history.

(56) References Cited

U.S. PATENT DOCUMENTS

| | | | |
|---|---|---|---|
| 2,616,046 | A | 10/1952 | Marston et al. |
| 2014/0330355 | A1 | 11/2014 | Stevenson et al. |

OTHER PUBLICATIONS

Murphy, PCT/CA2018/050847, International Preliminary Report on Patentability, dated Jul. 19, 2019, IPEA/CA, Canadian Intellectual Property Office, Canada.
Murphy, PCT/CA/2018/05847, International Search Report and Written Opinion, dated Oct. 1, 2018, ISA/CA, Canadian Intellectual Property Office, Canada.

*Primary Examiner* — Graham P Smith
(74) *Attorney, Agent, or Firm* — Crowe & Dunlevy, P.C.

(57) ABSTRACT

A double helical coil antenna includes a low frequency helical coil configured to operate in axial mode emitting a beam of radio waves with circular polarization in a preselected direction, wherein one end of the low frequency helical coil terminating on a ground plate. It further includes a higher frequency helical coil configured to operate in axial mode emitting a beam of radio waves with circular polarization in a preselected direction, wherein the higher frequency helical coil concentrically mounted within the low frequency helical coil and with one end terminating onto the same ground plate, wherein the higher frequency helical coil selected to have opposite polarization to the low frequency coil. Preferably the antenna further includes a beam reflector cup mounted onto the ground plate having a cup bottom and a cup wall wherein the diameter is dimensioned to fit in between the low frequency helical coil and the higher frequency helical coil thereby increasing the gain of the higher frequency helical coil.

22 Claims, 11 Drawing Sheets

DOUBLE HELICAL ANTENNA

FIELD OF THE INVENTION

The present invention relates to helical antennas, and in particular to a double helix antenna for use in communicating air born objects such as drones for communication and anti-drone activities as well as in mining applications and potentially other applications.

BACKGROUND OF THE INVENTION

Helical antennas are widely used and their operating characteristics are well known and understood in the art. A helical antenna consists of a conducting wire wound in the form of a helix usually referred to as the number of 360 degree turns of equal diameter having a preselected pitch. In most cases, helical antennas are mounted over a ground plate with a feed line connected between the bottom of the helix and the ground plate. Helical antennae operate in one of two modes called normal mode and axial mode. To operate in axial mode usually a minimum of three turns are necessary. The greater number of turns increases the antenna gain but also increases its length and reduces the beam width making the antenna more directional.

Helical antennae operate in axial mode, is a non-resonant traveling wave mode where the waves of current and voltage travel in one direction up the helix. The antenna radiates a beam of radio waves with circular polarization along the axis, off the ends of the antenna. One end of the helix is terminated on a combination of a flat metal sheet, plate, cup or screen reflector to reflect waves forward in the desired direction.

In axial mode, also known as end-fire mode, the dimensions of the helix are comparable to a wavelength. The antenna functions as a somewhat directional antenna radiating a beam at the ends of the helix, along the antenna's axis. It radiates circularly polarized waves that are used traditionally for satellite and other forms of communication.

Circular polarization is often used where the relative orientation of the transmitting and receiving antennas cannot be easily controlled or where the polarization of the signal may change.

The helix in the antenna can twist in two possible directions: right-handed or left handed, as defined by the right-hand rule. The direction of the twist of the helix in the antenna determines the polarization of the radio waves. Helical antennas can receive signals with any type of linear polarization, such as horizontal or vertical polarization, but when receiving circularly polarized signals, the handedness of the receiving antenna must be the same as the transmitting antenna.

The dimensions of the helix are determined by the wavelength $\lambda$ of the radio waves used, which depends on the frequency. The circumference of the antenna should be roughly equal to the wavelength. Therefore the diameter of the coil is approximately wavelength/pi=$\lambda/\pi$. A 5.8 GHz coil has a wavelength of about 2.03" and would have a theoretical diameter of 0.65 inches and a 2.4 GHz coil has a wavelength of about 4.92" and would have a theoretical diameter of 1.56 inches. The pitch angle is usually about 13 degrees, meaning the spacing between the coils should be approximately ¼ of the wavelength ($\lambda/4$). The number of turns in the helix determines the gain and how directional the antenna is. Therefore more turns improves the gain in the direction of the axis at a cost of gain in other directions.

Circularly polarized antenna provides numerous performance advantages over linear technologies. Circularly polarized antennas transmit in all planes providing a more reliable signal link for mobile devices that may have random antenna or signal orientations. Transmission in all planes leads to better signal propagation as there is a higher probability of penetration of the signal.

Double helical antenna's wherein one helical coil is concentrically mounted within another is to the inventors knowledge not been successfully applied since the outer coil attenuates the signal from the inner coil destroying the inner coils effectiveness. Therefore double helical coil antennas with the coils concentrically mounted are not used. There is however a need for this type of antenna since if it were possible to make this type of antenna configuration work effectively it would allow transmission of two different frequencies simultaneously with one antenna which is highly desirable due to reduced cost, space, ease of use and efficiency. The alternative is to have two separate antennas which normally must be operated by two separate individuals.

The inventors have discovered that by reversing the polarization between the inner and outer coils the attenuation can be minimized.

Furthermore reflector cups have been used on single helical antennas in order to increase the antenna gain without increasing the number of turns and therefore the length of the antenna. All of the existing literature has demonstrated that the correct dimension of the reflector cup is with a diameter of approximately one wavelength ($1\lambda$) in order to obtain gain improvements. In other words the diameter of the reflector cup should be about three times the diameter of the helical coil as shown in FIG. 17. The gain improvement using reflector cups with a diameters less than one wavelength ($1\lambda$) falls off rapidly to the point that at a reflector cup diameter of ½ $\lambda$ the wavelength almost no increase in gain is observed.

The inventors have stumbled upon that with double concentrically positioned helical coils by using a cup with about ½ $\lambda$ the diameter of the wavelength of the inner high frequency coil one is able to obtain substantial gain increases of the order of 2 DBi for the high frequency inner antenna which the literature teaches is not obtainable. Therefore the inventors have surprisingly discovered that gain of the high frequency inner antenna can be improved to the point that a double helical antenna with concentrically mounted helix's are useable as high gain antennas by using reverse circulation polarities and by using a small reflector cup mounted between the helix's having a diameter of about ½ $\lambda$.

Considerable experimentation and often unconventional and counter intuitive concepts were tested to come to this result. Antenna performance is scalable particularly for helical antennas and therefore there is no reason why this concept shouldn't work for any combination of radio frequencies chosen. Antenna technology predicts that this technology is completely scalable would be effective for any combination of frequencies. The inventor has been able to reproduce these results for frequencies wherein the higher frequency coil having a frequency within the range 5.3 GHz and 6.3 GHz and wherein the low frequency coil having a frequency within the range 1.9 GHz and 2.9 GHz.

BRIEF DESCRIPTION OF THE DRAWINGS

The present will now be describe by way of example only with reference to the following drawings in which.

DETAILED DESCRIPTION OF THE PREFERRED EMBODIMENTS

Antenna gain is usually defined as the ratio of the power produced by the antenna from a far-field source on the antenna's beam axis to the power produced by a hypothetical lossless isotropic antenna, which is equally sensitive to signals from all directions.

The expression dBi is used to define the gain of an antenna system relative to an isotropic radiator at radio frequencies. The symbol is an abbreviation for "decibels relative to isotropic." The dBi specification is based on the decibel, a logarithmic measure of relative power.

Figure 1:
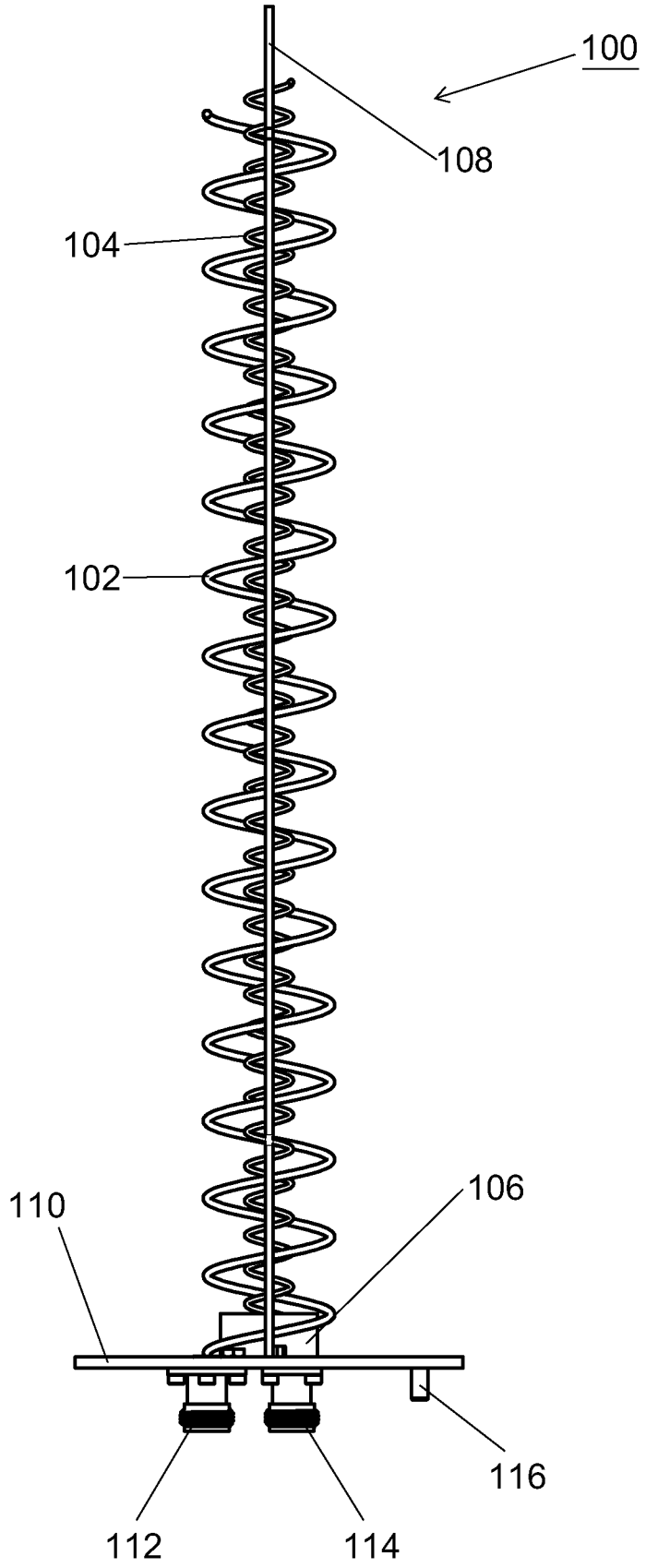
FIG. 1 is a schematic side elevation view of a double helix antenna.
Figure 2:
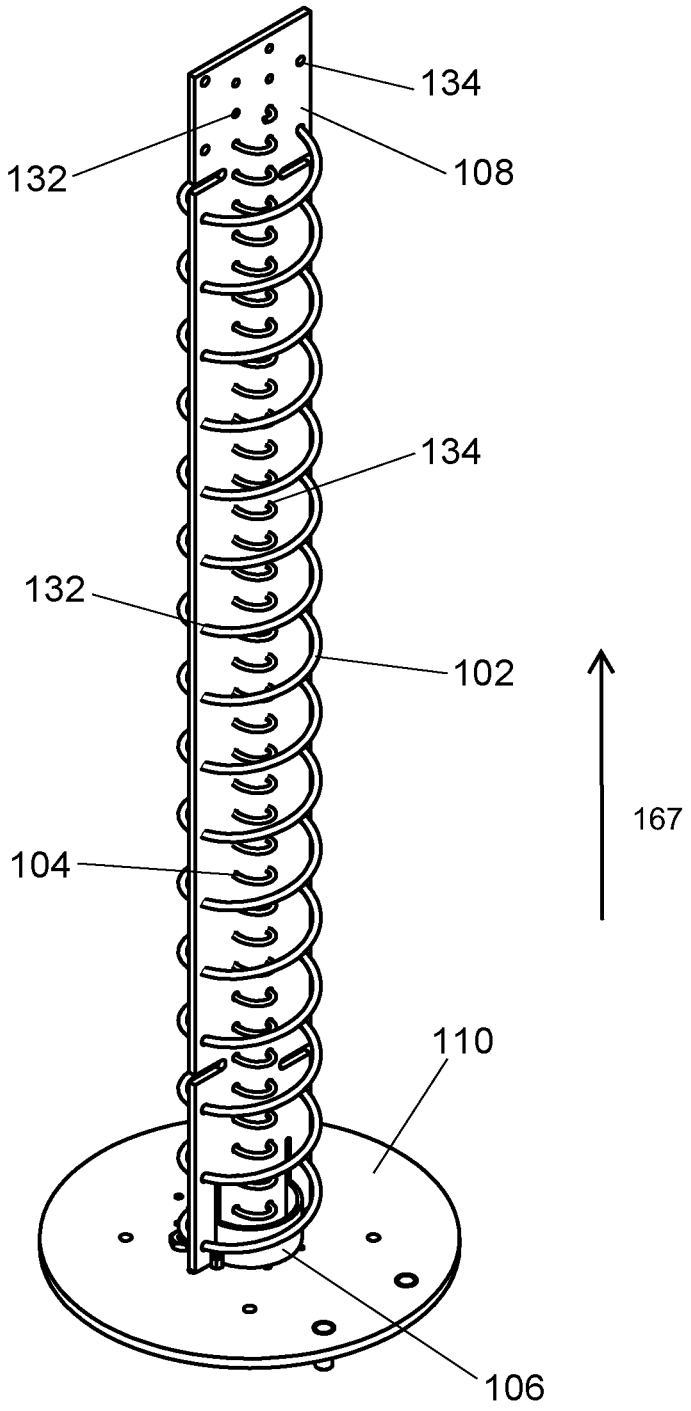
FIG. 2 is a schematic top front perspective view of a double helix antenna.

Referring first to FIGS. 1 and 2 which schematically depict double helical antenna 100 which is comprised of coil support board 108, 2.4 GHz right hand helical coil 102, 5.8 GHz left hand helical coil 104, cylindrical beam deflector cup 106, ground plate 110, mounting stud 116, 2.4 GHz N female connector 112 and 5.8 GHz N female connector 114.

Coil support board 108 is mounted onto ground plate 110 and holds 2.4 GHz right hand helical coil 102 and 5.8 GHz left hand helical coil 104. 2.4 GHz right hand helical coil 102 loops through 2.4 GHz coil apertures 134 and 5.8 GHz left hand helical coil 104 loops through 5.8 GHz apertures 132 on coil support board 108. Mounting stud 116 mounts ground plate 110 to any desired mounting platform.

Cylindrical beam deflector cup 106 is mounted on ground plate 110 between 2.4 GHz right hand helical coil and 5.8 GHz left hand helical coil so that 5.8 GHz left hand helical coil 104 is mounted within cylindrical beam deflector cup 106 and 2.4 GHz right hand helical coil 102 surrounds cylindrical beam deflector cup 106.

2.4 GHz right hand helical coil 102 connects to 2.4 GHz N female connector 112 and 5.8 GHz left hand helical coil 104 connects to 5.8 GHz N female connector 114.

Figure 3:
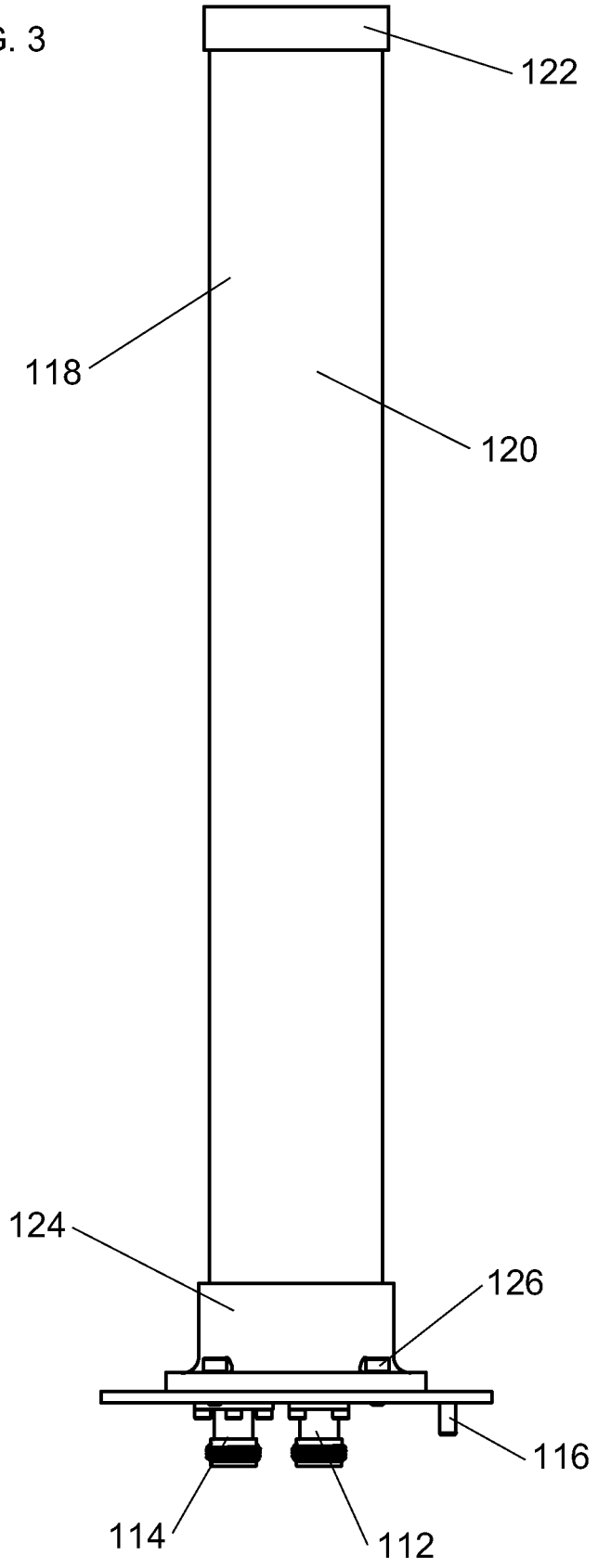
FIG. 3 is a schematic side elevation view of a double helix antenna with coil support board housing.
Figure 4:
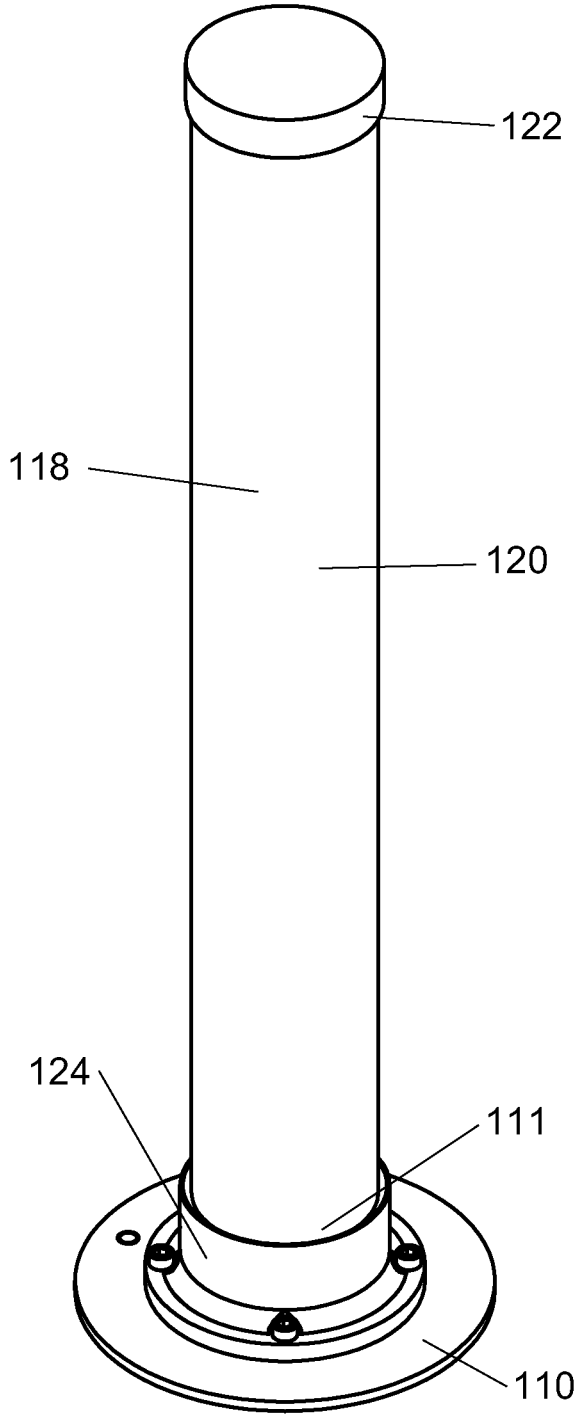
FIG. 4 is a schematic top front perspective view of a double helix antenna with coil support board housing.

FIGS. 3 and 4 shows double helical antenna 100 with coil support board housing 120 which covers and protects coil support board 108 and the helical coils. Base flange 124 is mounted to ground plate 110 with flange fastener 126 and protects and supports housing 120 proximate the bottom 111. Coil support board housing 120 is made of a polycarbonate radome 118 and an end cap 122. Coil support board housing 120 is mounted within base flange 124. End cap 122 closes the top of coil support board housing 120.

Figure 5:
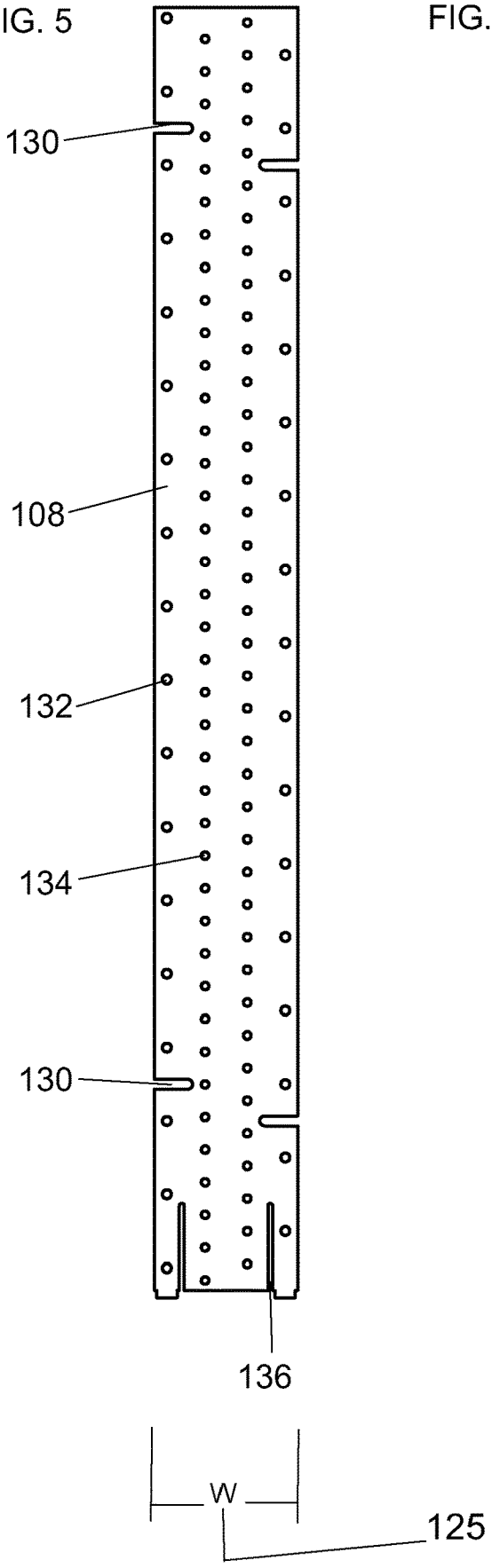
FIG. 5 is a schematic front elevation view of a coil support board.
Figure 6:
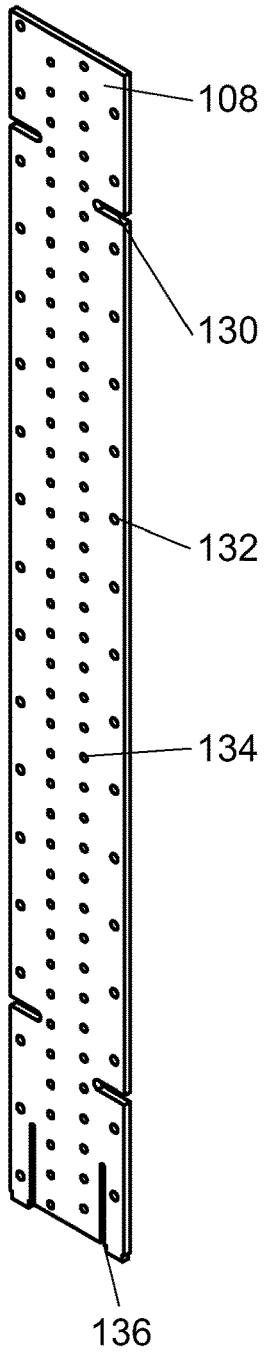
FIG. 6 is a schematic top front left perspective view of a coil support board.

FIGS. 5 and 6 depict coil support board housing 108 which includes board mounting slots 130, 2.4 GHz coil apertures 132, 5.8 GHz coil apertures 134 and cup mounting slots 136. Opposite polarization minimizes the interference and increases insulation and isolation of the two signals.

Figure 7:
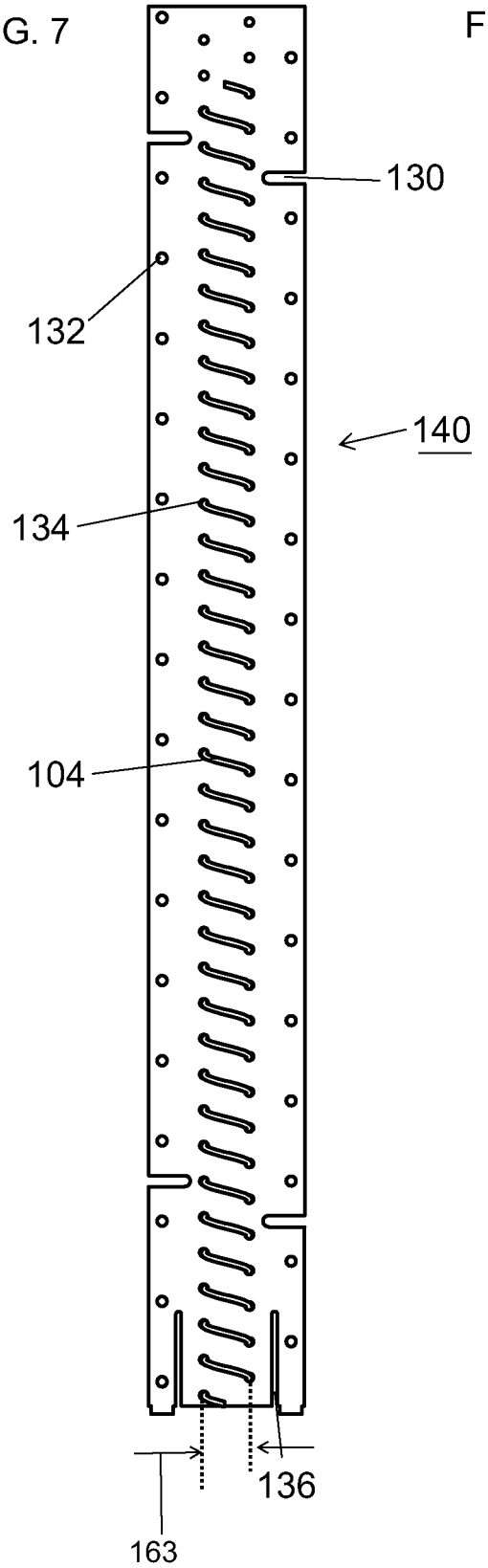
FIG. 7 is a schematic front elevation view of a coil support board with 5.8 GHz left hand coil.
Figure 8:
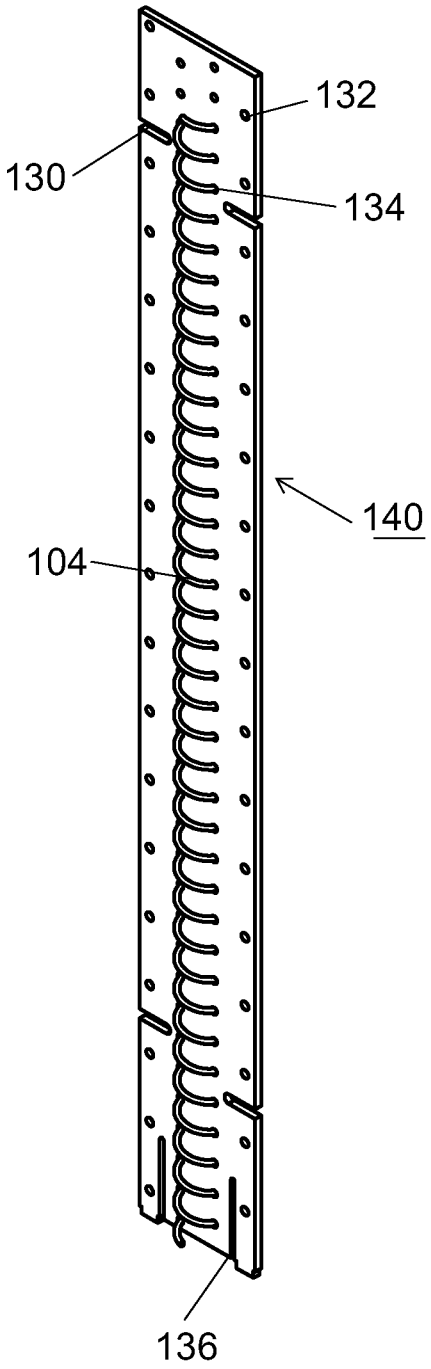
FIG. 8 is a schematic top front left perspective view of a coil support board with 5.8 GHz left hand coil

FIGS. 7 and 8 depict coil support board housing 108 with 5.8 GHz left hand helical coil 104 deployed onto coil support board 108, in left hand polarization 140. 5.8 GHz left hand helical coil 104 coils through 5.8 GHz coil apertures 134.

Figure 9:
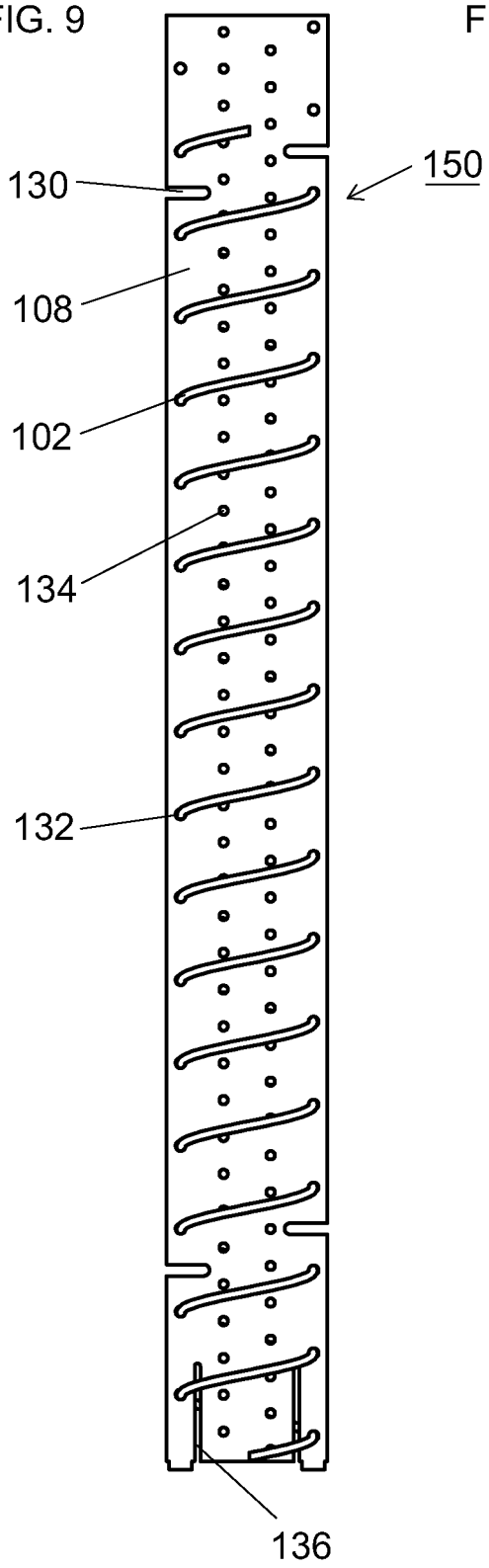
FIG. 9 is a schematic front elevation view of a coil support board with 2.4 GHz right hand coil.
Figure 10:
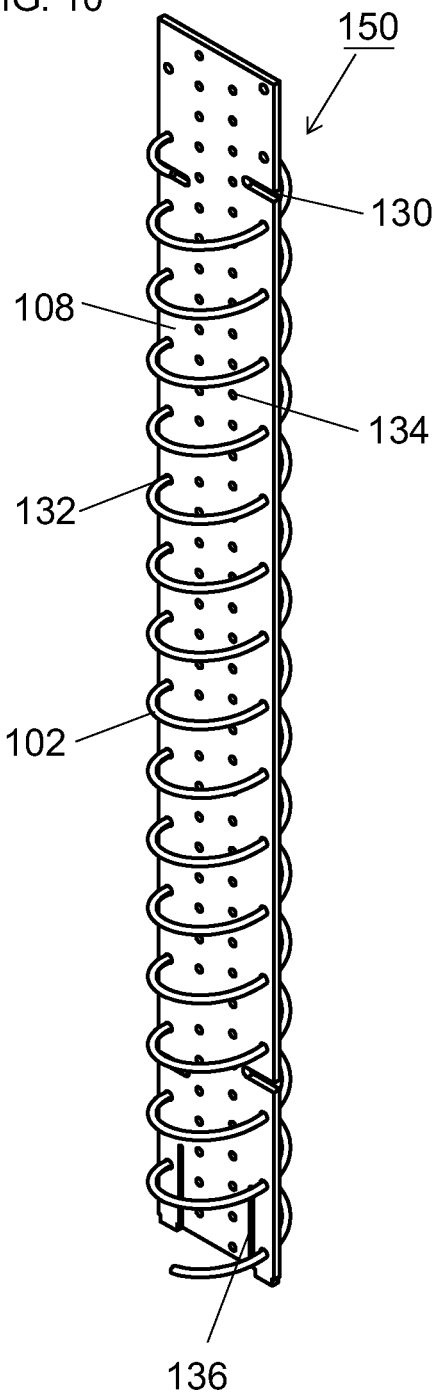
FIG. 10 is a schematic top front left perspective view of a coil support board with 2.4 GHz right hand coil.
Figure 11:
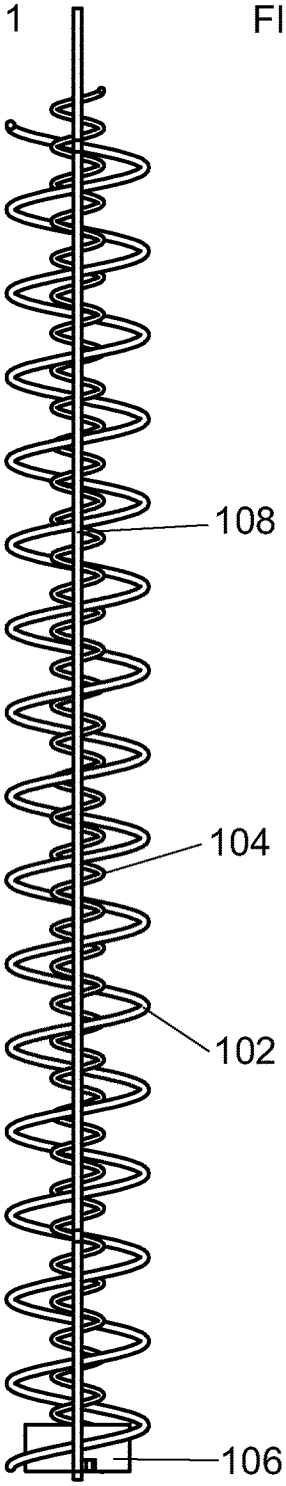
FIG. 11 is a schematic left side elevation view of a coil support board with 5.8 GHz left hand coil and 2.4 GHz right hand coil in combination with a cylindrical beam deflector cup.
Figure 12:
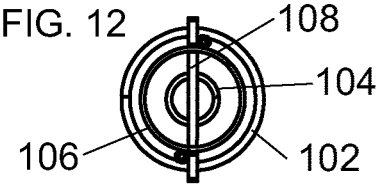
FIG. 12 is a schematic top end view of a coil support board with 5.8 GHz left hand coil and 2.4 GHz right hand coil in combination with a cylindrical beam deflector cup.
Figure 13:
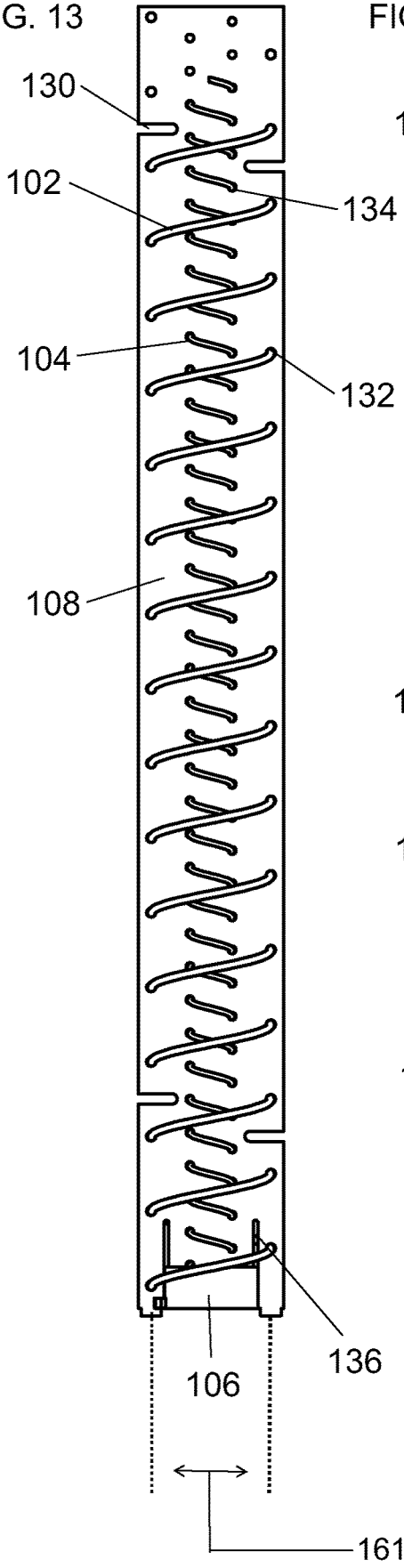
FIG. 13 is a schematic front elevation view of a coil support board with 5.8 GHz left hand coil and 2.4 GHz right hand coil in combination with a cylindrical beam deflector cup.
Figure 14:
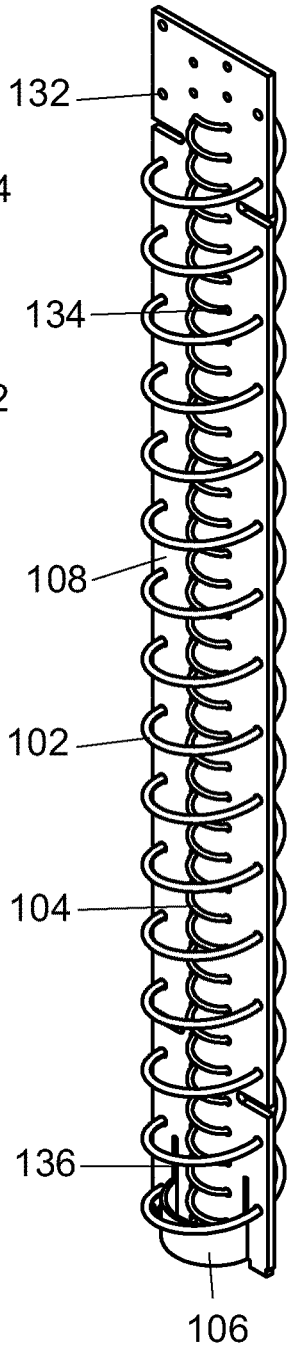
FIG. 14 is a schematic top front left perspective view of a coil support board with 5.8 GHz left hand coil and 2.4 GHz right hand coil in combination with a cylindrical beam deflector cup.

FIGS. 9 and 10 show support board housing 108 with 2.4 GHz right hand helical coil 102 deployed onto coil support board 108, in right hand polarization 150. 2.4 GHz right hand helical coil 102 coils through 2.4 GHz coil apertures 132.

FIGS. 11, 12, 13 and 14 show support board housing 108 with both 2.4 GHz right hand helical coil 102 and 5.8 GHz left hand helical coil, in combination with cylindrical beam deflector cup 106. Cylindrical beam deflector cup 106 rests within cup mounting slots 136 which places cylindrical beam deflector cup 106 within the interior of the helix of 2.4 GHz right hand helical coil 102 and surrounding the helix of 5.8 GHz left hand helical coil 104.

Figure 15:
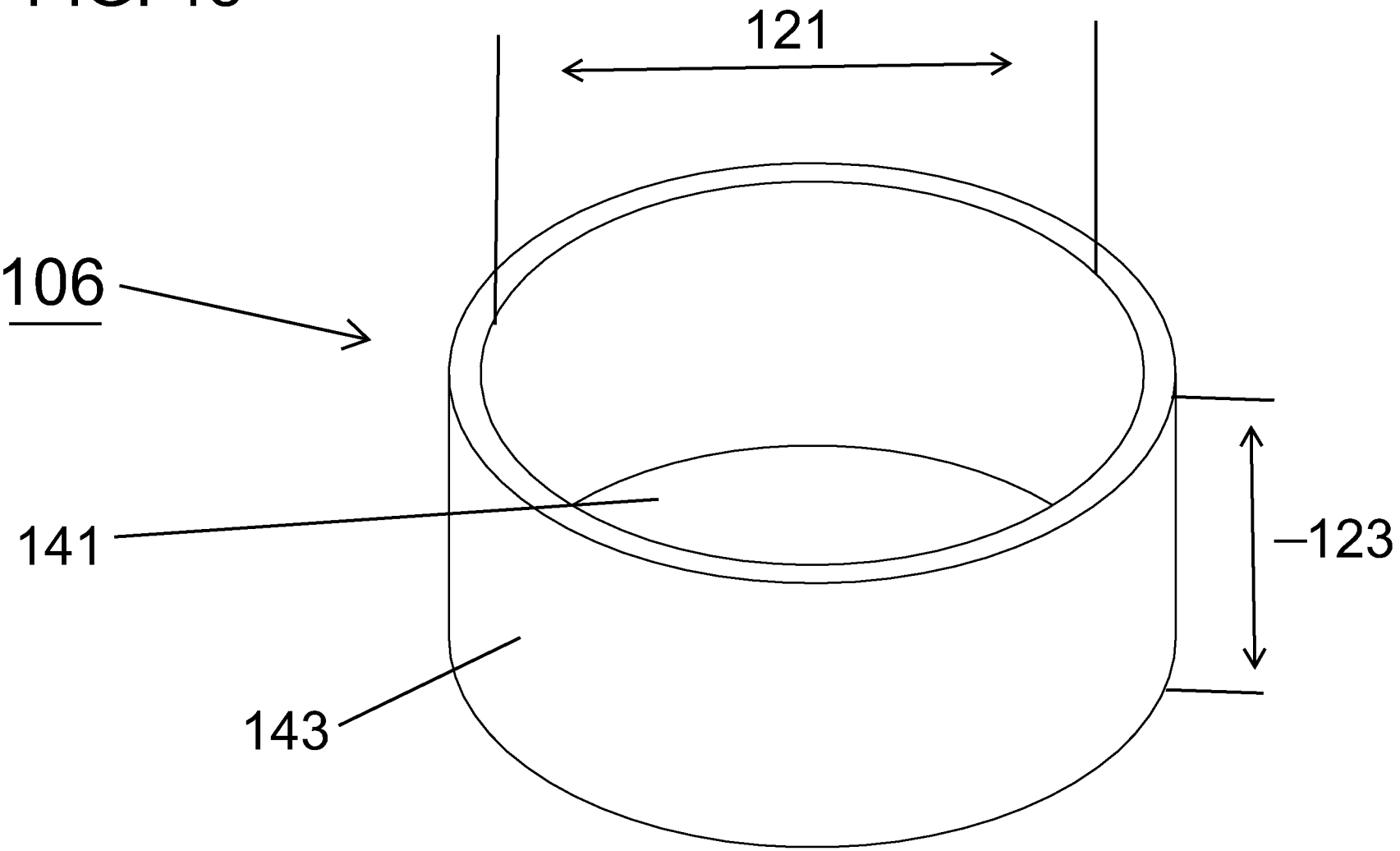
FIG. 15 is a schematic top perspective view of a cylindrical beam deflector cup.
Figure 16:
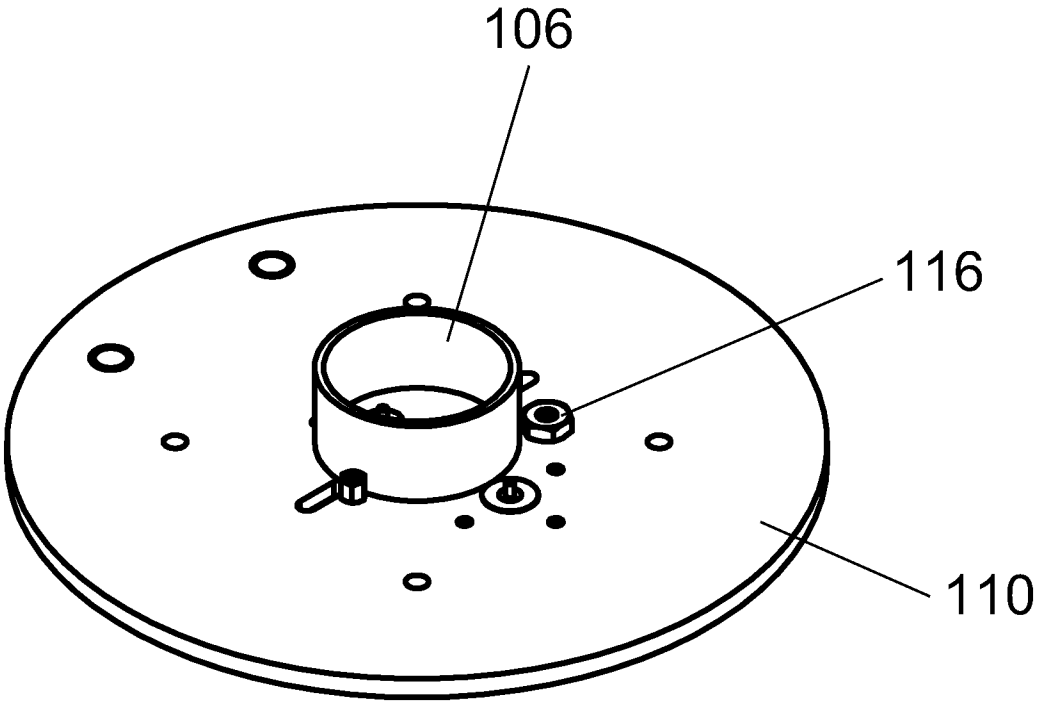
FIG. 16 is a schematic top perspective view of a cylindrical beam deflector cup installed with a ground plate.

FIG. 15 shows cylindrical beam deflector cup 106 in isolation and FIG. 16 shows cylindrical beam deflector cup 106 mounted onto ground plate 110.

The double helical coil antenna 100 includes:

a) a 2.4 GHz right hand helical coil also referred to herein as simply a low frequency helical coil 102 configured to operate in axial mode emitting a beam of radio waves with circular polarization in a preselected direction, wherein one end of the low frequency helical coil terminating on a ground plate 110;

b) a 5.8 GHz left hand helical coil simply referred to herein as a higher frequency helical coil 104 configured to operate in axial mode emitting a beam of radio waves with circular polarization in a preselected direction, wherein the low frequency helical coil concentrically mounted within the low frequency helical coil and with one end terminating onto the same ground plate 110;

c) wherein the higher frequency helical coil 104 selected to have opposite polarization to the low frequency coil 102.

Preferably the double helical coil antenna 100 includes a cylindrical beam reflector cup 106 mounted onto the ground plate 110 having a cup bottom 141 and a cup wall 143 wherein the diameter 121 is dimensioned to fit in between the low frequency helical coil 102 and the higher frequency helical coil 104 thereby increasing the gain of the higher frequency helical coil 104.

Preferably wherein the higher frequency coil 104 having a HF coil diameter 163 of wavelength/π±50% and the lower frequency coil having a LF coil diameter 161 of wavelength/π±50%.

Preferably the cup diameter 121 is greater than the diameter of the HF coil diameter 163, also referred to as simply the diameter of the higher frequency coil but less than the LF coil diameter 161 also simply referred to as the diameter of the lower frequency coil.

Preferably wherein the cup diameter 121 is less than ⅔ of the wavelength of the higher frequency helical coil.

Preferably wherein the cup diameter 121 is ½ of the wavelength of the higher frequency helical coil ±20%.

Preferably wherein the cup height 123 is ¼ of the wavelength of the higher frequency helical coil ±20%.

Preferably wherein the higher frequency coil 104 having a frequency within the range 5.3 GHz and 6.3 GHz.

Preferably wherein the higher frequency coil 104 having a frequency within the range 5.7 GHz and 5.9 GHz.

Preferably wherein the low frequency coil 102 having a frequency within the range 1.9 GHz and 2.9 GHz.

Preferably wherein the low frequency coil 102 having a frequency within the range 2.2 GHz and 2.6 GHz.

Preferably wherein the cup diameter 121 is ½ of the wavelength of the higher frequency helical coil 104 ±20%.

Preferably wherein the higher frequency coil 104 having a frequency within the range 5.7 GHz and 5.9 GHz and wherein the low frequency coil 102 having a frequency within the range 2.2 GHz and 2.6 GHz.

Preferably wherein the cup diameter 121 is ½ of the wavelength of the higher frequency helical coil 104 ±20%.

Preferably further including a coil support board 108 adapted to support and hold the position of the helical coils, the coil support board 108 having a width greater than the diameter of the low frequency helical coil 161 and height configured to support all the turns of both the a low frequency helical coil 102 and the a high frequency helical coil 104.

Preferably wherein the coil support board 108 including coil support apertures 134 and 132 spaced along the axial 167 length of the coil support board and placed at intervals to maintain the coil geometry of the coils.

Preferably wherein the coil support board 108 includes one end terminating at and affixed to the ground plate 110 to rigidly maintain the positioning of the coil support board 108.

Preferably wherein the coil support board 108 further includes two spaced apart substantially parallel cup mounting slots 136 for receiving the cup wall 143 therein thereby maintaining the positioning of the cup 106.

Preferably wherein the low frequency helical coil 102 and the high frequency helical coil 104 connected to N female connectors 112 and 114 extending from a bottom of the ground plate 110.

In Use

Figure 17:
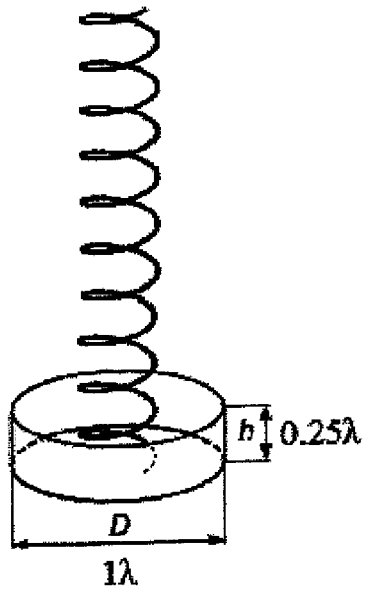
FIG. 17 is a schematic representation of a helical antenna showing the current deflector cup diameter.

The inventor has unexpectedly found that placing the cylindrical portion of cylindrical beam deflector cup 106 between 2.4 GHz right hand helical coil 102 and 5.8 GHz left hand helical coil 104 results in a greater amplification and gain of the signal than would be expected, almost doubling the performance of the antenna. The current art teaches that a cylindrical beam deflector cup should be placed surrounding both helical coils. The art teaches placing the beam deflector cup between the helical coils would reduce amplification and gain of the signal. The current art, as depicted in FIG. 17, indicates that cylindrical beam deflector cup has an optimal diameter equal to one wavelength and should be placed surrounding the helical coil to increase gain. The prior art teaches that placing the beam deflector cup between two helical coils would reduce amplification and gain of the signal. The inventor unexpectedly discovered that a beam deflector cup 106 close to one half of a wavelength in diameter still has the desired effect on 5.8 GHz left hand helical coil 104 due to the fact that the diameter of the beam deflector cup is smaller than optimal and situated in the interior of the 2.4 GHz coil. We believe the presence of the 2.4 GHz coil to have some unknown effect.

Additionally the use of two different concentric helical antennae, each tuned to a different frequency, allows for a greater range in frequencies to be used.

In mining applications it has also been unexpectedly observed that signal reflections are much reduced using the present design.

The invention claimed is:

1. A double helical coil antenna which includes:

a) a low frequency helical coil configured to operate in axial mode emitting a beam of radio waves with circular polarization in a preselected direction, wherein one end of the low frequency helical coil terminating on a ground plate;

b) a higher frequency helical coil configured to operate in axial mode emitting a beam of radio waves with circular polarization in a preselected direction, wherein the higher frequency helical coil concentrically mounted within the low frequency helical coil and with one end terminating onto the same ground plate, c) wherein the higher frequency helical coil selected to have opposite polarization to the low frequency coil.

2. The double helical coil antenna claimed in claim 1 further including a beam reflector cup mounted onto the ground plate having a cup bottom and a cup wall wherein the diameter is dimensioned to fit in between the low frequency helical coil and the higher frequency helical coil thereby increasing the gain of the higher frequency helical coil.

3. The double helical coil antenna claimed in claim 2 wherein the higher frequency coil having a coil diameter of wavelength/π±50% and the lower frequency coil having a diameter of wavelength/π±50%.

4. The double helical coil antenna claimed in claim 3 wherein the cup diameter is greater than the diameter of the higher frequency coil but less than the diameter of the lower frequency coil.

5. The double helical coil antenna claimed in claim 4 wherein the cup diameter is less than ⅔ of the wavelength of the higher frequency helical coil.

6. The double helical coil antenna claimed in claim 5 wherein the cup diameter is ½ of the wavelength of the higher frequency helical coil ±20%.

7. The double helical coil antenna claimed in claim 6 wherein the cup height is ¼ of the wavelength of the higher frequency helical coil ±20%.

8. The double helical coil antenna claimed in claim 1 wherein the higher frequency coil having a frequency within the range 5.3 GHz and 6.3 GHz.

9. The double helical coil antenna claimed in claim 1 wherein the higher frequency coil having a frequency within the range 5.7 GHz and 5.9 GHz.

10. The double helical coil antenna claimed in claim 1 wherein the low frequency coil having a frequency within the range 1.9 GHz and 2.9 GHz.

11. The double helical coil antenna claimed in claim 1 wherein the low frequency coil having a frequency within the range 2.2 GHz and 2.6 GHz.

12. The double helical coil antenna claimed in claim 9 wherein the cup diameter is ½ of the wavelength of the higher frequency helical coil ±20%.

13. The double helical coil antenna claimed in claim 1 wherein the higher frequency coil has a frequency within the range 5.7 GHz and 5.9 GHz and wherein the low frequency coil has a frequency within the range 2.2 GHz and 2.6 GHz.

14. The double helical coil antenna claimed in claim 13 wherein the cup diameter is ½ of the wavelength of the higher frequency helical coil ±20%.

15. The double helical coil antenna claimed in claim 2 further including a coil support board adapted to support and hold the position of the helical coils, the coil support board having a width greater than the diameter of the low frequency helical coil and height configured to support all the turns of both the a low frequency helical coil and the a high frequency helical coil.

16. The double helical coil antenna claimed in claim 15 wherein the coil support board including coil support apertures spaced along the axial length of the coil support board and placed at intervals to maintain the coil geometry.

17. The double helical coil antenna claimed in claim 15 wherein the coil support board includes one end terminating at and affixed to the ground plate to rigidly maintain the positioning of the coil support board.

18. The double helical coil antenna claimed in claim 15 wherein the coil support board further includes two spaced apart substantially parallel cup mounting slots for receiving the cup walls therein thereby maintaining the positioning of the cup.

19. The double helical coil antenna claimed in claim 2 wherein the low frequency helical coil and the high frequency helical coil connected to N female connectors extending from a bottom of the ground plate.

20. The double helical coil antenna claimed in claim 1 wherein the higher frequency coil has a frequency within the range 5.7 GHz and 5.9 GHz and wherein the low frequency coil has a frequency within the range 2.3 GHz and 2.5 GHz.

21. A double helical coil antenna comprising:

a) a low frequency helical coil configured to operate in axial mode emitting a beam of radio waves with circular polarization in a preselected direction, wherein one end of the low frequency helical coil terminating on a ground plate;

b) a higher frequency helical coil configured to operate in axial mode emitting a beam of radio waves with circular polarization in a preselected direction, wherein the higher frequency helical coil concentrically mounted within the low frequency helical coil and with one end terminating onto the same ground plate, and c) a beam reflector cup mounted onto the ground plate, the beam reflector cup having diameter that is dimensioned to fit in between the low frequency helical coil and the higher frequency helical coil thereby increasing the gain of the higher frequency helical coil;

wherein the higher frequency helical coil selected to have opposite polarization to the low frequency coil.

22. The double helical coil antenna claimed in claim 11 wherein the cup diameter is ½ of the wavelength of the higher frequency helical coil ±20%.

* * * * *